US012629559B2

(12) United States Patent
Kozak

(10) Patent No.: US 12,629,559 B2
(45) Date of Patent: May 19, 2026

(54) NECK EXERCISING APPARATUS

(71) Applicant: Dmitrii Petrovich Kozak, Moscow (RU)

(72) Inventor: Dmitrii Petrovich Kozak, Moscow (RU)

( * ) Notice: Subject to any disclaimer, the term of this patent is extended or adjusted under 35 U.S.C. 154(b) by 112 days.

(21) Appl. No.: 18/837,319

(22) PCT Filed: Jan. 16, 2023

(86) PCT No.: PCT/RU2022/000386
§ 371 (c)(1),
(2) Date: Aug. 9, 2024

(87) PCT Pub. No.: WO2024/112227
PCT Pub. Date: May 30, 2024

(65) Prior Publication Data

US 2025/0186831 A1 Jun. 12, 2025

(30) Foreign Application Priority Data

Nov. 24, 2022 (RU) ..... 2022130532

(51) Int. Cl.
*A63B 23/025* (2006.01)
*A63B 21/00* (2006.01)
*A63B 21/005* (2006.01)

(52) U.S. Cl.
CPC ..... *A63B 23/025* (2013.01); *A63B 21/00065* (2013.01); *A63B 21/0052* (2013.01); *A63B 21/4043* (2015.10)

(58) Field of Classification Search
CPC . A63B 21/00065; A63B 21/02; A63B 21/023; A63B 21/025; A63B 21/04;
(Continued)

(56) References Cited

U.S. PATENT DOCUMENTS 4,278,249 A * 7/1981 Forrest ..... A63B 23/025 482/10
4,537,393 A * 8/1985 Kusch ..... A63B 23/025 482/129
(Continued)

FOREIGN PATENT DOCUMENTS

CA 2999421 A1 * 3/2017 ..... A63B 21/02
CN 105457231 A * 4/2016 ..... A63B 21/045
(Continued)

*Primary Examiner* — Gary D Urbiel Goldner
(74) *Attorney, Agent, or Firm* — Nadya Reingand

(57) ABSTRACT

The present exercising apparatus is adapted for exercising a neck of a user. The exercising apparatus comprises a stand, a headband, and elastic elements for transmitting load. The stand comprises a frame having shoulder rests and handles attached to an underside thereof. The frame is also equipped with brackets oriented in an outward and upward direction. The headband is designed to be placed on and secured to a head of the user. The elastic elements are connected at one end to the headband and at another end to the brackets so that the headband is suspended in a middle of the frame by the stretched elastic elements. There is at least one bracket on each side of the frame. The exercising apparatus enables more effective exercising of the neck muscles by making it possible to exercise different groups of neck muscles simultaneously in all directions.

3 Claims, 4 Drawing Sheets

(58) Field of Classification Search
CPC ..... A63B 21/0407; A63B 21/0414; A63B 21/0428; A63B 21/0435; A63B 21/0442; A63B 21/0552; A63B 21/1672; A63B 21/4003; A63B 21/4027; A63B 21/4033; A63B 21/4043; A63B 23/025; A63B 2023/006; A63B 2208/0228
See application file for complete search history.

(56) References Cited

U.S. PATENT DOCUMENTS 4,645,198 A * 2/1987 Levenston ..... A63B 23/025 482/10
4,832,333 A 5/1989 Lockett
5,507,707 A * 4/1996 Miller ..... A63B 21/0004 482/10
5,984,836 A * 11/1999 Casali ..... A63B 21/4003 602/17
7,468,019 B2 12/2008 Dirk
8,840,528 B2 * 9/2014 Zylstra ..... A63B 21/4025 482/121
11,878,210 B1 * 1/2024 Torres ..... A63B 21/4005
2008/0119331 A1 * 5/2008 Zylstra ..... A63B 21/4003 482/10
2013/0059703 A1 * 3/2013 Calantoni ..... A63B 23/1209 482/126
2017/0203148 A1 * 7/2017 Askins ..... A63B 21/00185
2019/0351285 A1 * 11/2019 Kwun ..... A63B 21/1609
2024/0033565 A1 * 2/2024 Drake ..... A63B 21/4003

FOREIGN PATENT DOCUMENTS

CN 114159203 A * 3/2022 ..... A63B 71/0619
DE 202009014761 U1 * 7/2010 ..... A63B 23/025
RU 2050883 C1 * 12/1995
RU 2548507 C1 * 4/2015
RU 189411 U1 5/2019
RU 2805791 C1 * 10/2023

* cited by examiner

NECK EXERCISING APPARATUS

CROSS-REFERENCES

This patent application is a National stage application from PCT application PCT/RU2022/000386 filed Jan. 16, 2023, which claims priority to Russian patent application RU 2021139131 filed Dec. 27, 2021.

TECHNICAL FIELD

The invention relates to equipment adapted for training individual body parts, namely for training the neck. The present exerciser can be used in sports, as well as in rehabilitation medicine in recovery from injuries.

BACKGROUND OF THE INVENTION

It is known that in the spine, which consists of five regions, the cervical region is the first and most mobile. The cervical region consists of seven vertebrae that are joined together by cartilage tissue, where the intervertebral discs house the muscles that provide head movement. According to the international standard Terminologia Anatomica (TA), the intrinsic muscles of the neck (lat. mm. proprii colli) include two muscles that are lateral superficial muscles according to the Russian-language classification, four lateral deep muscles and two medial muscles. All of them perform very serious functions for the human body: the vertebrae of the cervical region keep the human head in balance; they ensure the rotation and inclination of the head; the process of swallowing food and pronouncing different sounds depends on them. Pathologies in the neck area can occur for many different reasons, but most of them appear precisely because of the untrained and weakened neck muscles. Neck diseases include osteochondrosis, herniation of cervical intervertebral bodies, neuralgia, spondylosis, etc. Therefore, the proper development of the neck muscles is very important for everyone, not only for athletes. That is why it is necessary to perform exercises for the neck.

Workouts to stretch and strengthen the neck muscles should be carried out in a calm rhythm and without sudden movements. The most important thing in training for pumping and strengthening the neck muscles is safety and proper technique of exercises. This is because the slightest mistake can lead to injury, the formation of chronic diseases.

To train the neck muscles, special devices are used, such as exercisers.

For example, RU 2548507 C1 (published 20 Apr. 2015) discloses a device for restoring the muscular corset of the cervical region. The device comprises a set of weights, an armchair for a patient which is rotary relative to its vertical axis and comprises shoulder girdle fixation elements and a Glisson loop connected to the weights by means of a flexible pull slung over a pulley. The pulley is arranged relative to the armchair such that a section of the pull between the Glisson loop fixed on the head of the patient sitting in the armchair and the pulley forms an angle of 10-30° relative to the vertical. The armchair is provided with a stop motion mechanism providing the rigid fixation of an angular position of the armchair with a predefined discreteness within the limits of its complete 360° turn, in any direction of rotation of the armchair.

This exerciser is extremely ineffective for training, because of the fixation of a trainee to the exerciser in the shoulder girdle in a sitting position and the fixation of the Glisson loop on the head by the chin. The flexible pull is attached at one end to a Glisson loop and at the other end to a weight, so that the person has no opportunity to observe the weight when sitting back and, in addition, to independently adjust the weight and the pace of exercise in the course of the exercise. Furthermore, the device does not allow one to train all groups of the neck muscles in different directions. Given that the human musculoskeletal system is built on the principle of tensegrity, vertical load will be realized on the cervical and underlying vertebrae, which is unsafe. The design of the exerciser is aimed at traction of the spine, so it is necessary to consider contraindications to spinal traction: osteoporosis, inflammatory processes in acute form, oncology, vertebral instability, epilepsy, kidney stones. Improper weight selection and overuse of this exerciser can lead to a number of complications such as intervertebral hernias and micro-tears of muscle tissue.

U.S. Pat. No. 8,840,528 B2 (published 23 Sep. 2014) discloses a portable neck exercising device comprising an adjustable frame that can be removably positioned between two sides of a door frame, a set of pulleys attached to the frame, a head band, and flexible tensioning bands attached to the head band, threaded through the pulleys, and removably connected to the frame using various tensions, such that a user can variably train their neck muscles by moving their head, neck, and torso in a variety of directions. According to U.S. Pat. No. 8,840,528 B2, the frame is adapted for adjustable installation in a doorway with the possibility of length adjustment.

The disadvantages of the technical solution known from U.S. Pat. No. 8,840,528 B2 are also inefficiency of training due to lack of mobility, because the use of the excising device is possible only in doorways, which limits the area of its use. It is possible to make movements only in one vertical plane at a time, which means training only certain muscles.

The device design has no modules and elements that stabilize (fix the body) the underlying structures of the musculoskeletal system in relation to the cervical region, which practically excludes the possibility of isolated training of the muscles of the cervical region, i.e., the exercise is performed with the inclusion of the muscles of the underlying regions, thereby partially removing the load from the neck muscles and reducing the effectiveness of training.

RU 2050883 C1 (published 27 Dec. 1995) discloses a device for training the neck muscles, comprising a base on which a swivel stand with a seat is mounted, a swivel with a head holder and a means for its attachment to the stand, means for generating a load with load units for both the swivel and the stand, wherein the load units comprise friction elements. The friction elements of the load unit for the stand are fixed to the stand by means of a vertical axis, and the friction elements of the load unit for the swivel are fixed to a sleeve by means of a horizontal axis. The swivel forks are made of two parts, which are connected to each other by means of axial elements with rotatable fractional disks.

The disadvantages of the technical solution known from RU 2050883 C1 are its low mobility due to the presence of bulky elements in the design, training on the exerciser is possible only in a sitting position, which introduces a number of difficulties in the process of training. The device allows one to tilt the head in the vertical plane and rotate the torso in the horizontal plane, but for this it is necessary to rotate the nuts-handle, which is inconvenient to do during training. Furthermore, such a load creates unwanted tensile and compressive stresses on the spine, which is unsafe and requires proper training technique.

As the analysis of the prior art shows, the known neck exercisers have common disadvantages, which consist in the fact that they are not ergonomic, because for their functioning it is necessary to attach the elements creating the load to fixed objects, which are walls, doorways, and a trainee is tied to a certain place of training (chair, doorway). Furthermore, in order to change the direction of the load, it is necessary to change the attachment, which entails a forced interruption of training. Another problem is that the described exercisers cannot be considered effective and safe, because they are aimed at training only certain muscles of the neck: sternoclavicular-papillary, ladder muscles; the exercise in the exerciser is carried out in one plane with a translational-rotational movement, and they do not allow one to perform exercises qualitatively, to monitor the amplitude of the exercises. This may result in negative consequences due to incorrect direction of loads, which is especially critical during rehabilitation.

SUMMARY OF THE INVENTION

The present invention is aimed at solving the above problems, namely at creating a portable convenient-to-use exerciser which is independent of auxiliary devices (armchairs, doorways, etc.) and does not require re-equipment as compared to the prior art—i.e., replacement of elements of the exerciser for training different muscle groups at the same time, while meeting safety requirements and providing training of a significant number of the neck muscles-sternoclavicular-papillary, ladder, belt muscle of the head, belt muscle of the neck, short extensors (upper oblique, lower oblique, large straight, small straight), nuchal ligament, own ligaments and joints of the cervical region, ligaments and joints.

It is an objective of the present invention to increase the efficiency of training of the neck muscles by providing the possibility of training of different, in comparison with the prior art analogues, groups of the neck muscles simultaneously in all directions, while causing no vertical load on cervical vertebrae. Furthermore, all exercises are performed by an exerciser without auxiliary devices, without binding to a certain place of training and without having to change equipment of the device for training of different groups of muscles.

The technical result is achieved by the proposed exerciser design. The exerciser comprises the following main elements: a stand, a head band, and elastic load-creating elements. The stand comprises a frame, to which shoulder rests with handles are attached from below. The frame is also provided with brackets directed to the outer side of the frame, and vertical arms of the brackets are directed upwards. The head band is made with the possibility of being put on and fastened to the head. The elastic elements are connected at one end to the head band and at another end to the brackets, so that the head band is in the center of the frame, suspended by the side-stretched elastic elements. At least one of the brackets is made on each side of the frame. The elastic load-creating elements are springs, harnesses, rubber bands or other similar devices.

BRIEF DESCRIPTION OF DRAWINGS

The essence of the present invention is explained by the foregoing description and the accompanying drawings, in which.

DETAILED DESCRIPTION OF THE INVENTION

Figure 1:
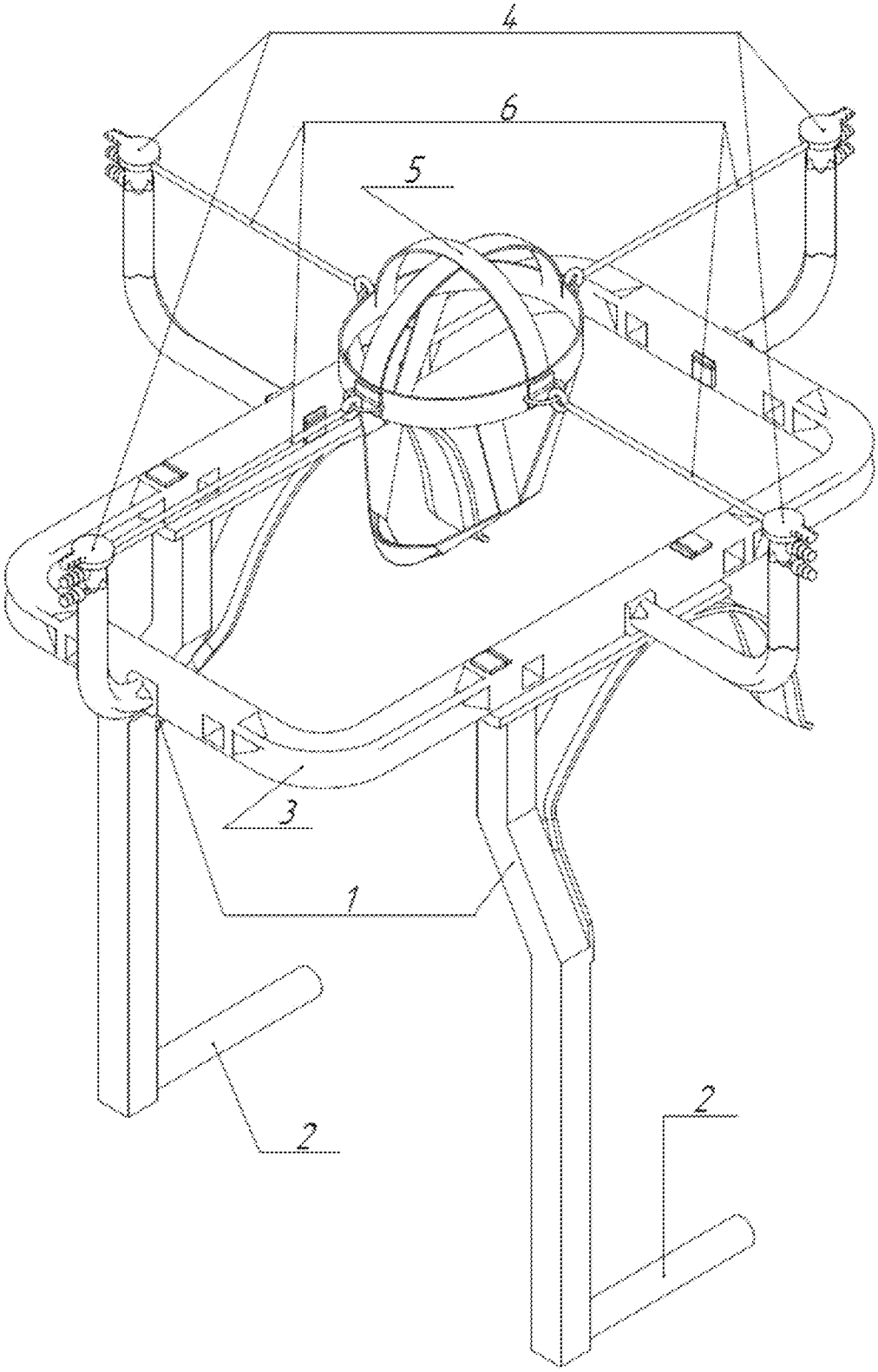
FIG. 1 shows a general view of an exerciser.
Figure 2:
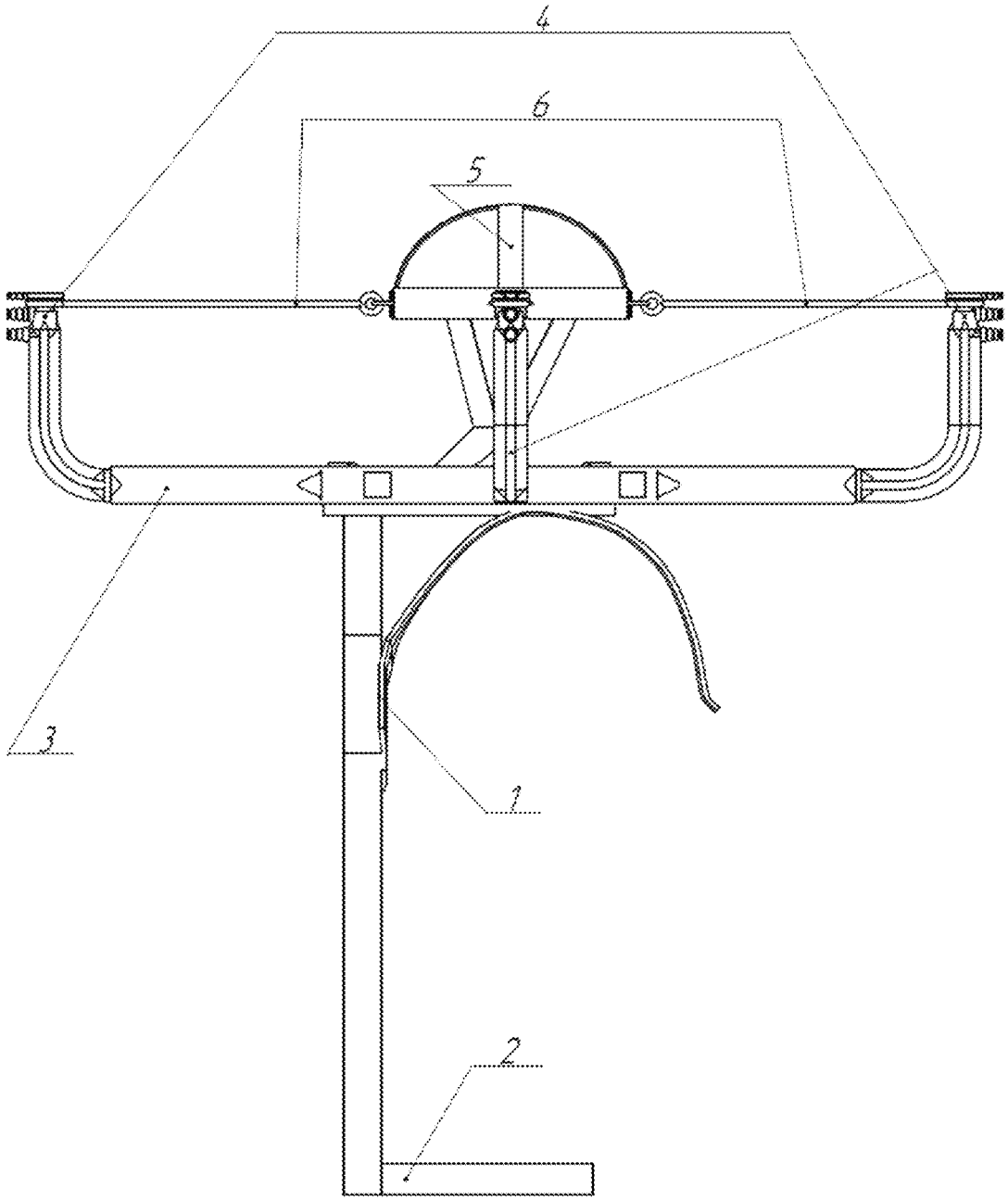
FIG. 2 shows a side view of the exerciser.
Figure 3:
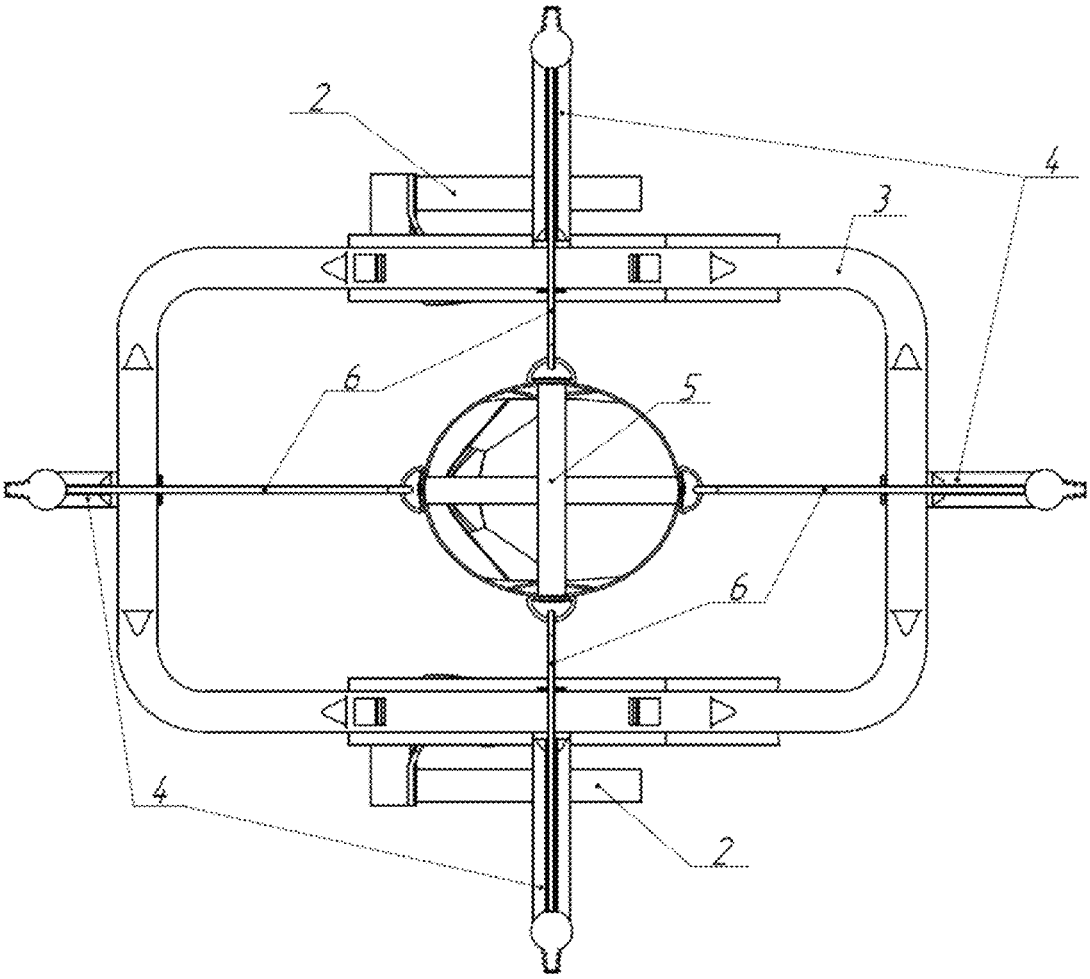
FIG. 3 shows a top view of the exerciser.

The main structural elements of a neck exerciser are as follows: a stand, a head band and elastic elements for load transfer.

The stand comprises a frame to which shoulder rests 1 are attached from below.

The shoulder rests 1 are intended for placing the exerciser on the shoulders of a trainee. Handles 2 for wrist grips with the hands extend downwards from the shoulder rests 1 so that they are located on the sides of the torso for comfortable holding of the exerciser.

The upper part of the stand, which is fixed on the shoulder rests 1, is made as a closed frame 3. The frame 3 rigidly connects the shoulder rests 1 with each other.

The shape of the frame 3 may be round, oval, square or other, which is not important for achieving the technical result. The presented examples of the embodiments of the invention show a frame of rectangular shape with rounded corners.

Depending on the physical data of the trainee, the size of the frame in the perimeter can be made according to individual features, but considering that for convenient use of the exerciser, the distance of the frame from the neck should be not less than 3 cm and not more than 70 cm.

Brackets 4 are attached to the frame 3 on each side, facing the outside of the frame, with vertical arms of the brackets facing upwards.

A head band 5 is a band or helmet, allowing it to fit snugly on the head of the trainee. The band is made of a horizontally positioned, head-size-adjustable hoop with adjustable vertical half-hoops attached to it from above and encircling the top of the head, as well as an adjustable half-hoop under the chin from below. The band may be made of leather or eco-leather, textile, plastic and other similar materials.

A tactical helmet can be used instead of the band.

The band is attached to elastic elements 6 that create a load. Any parts having elastic characteristics, such as springs, harnesses, shock absorbers or rubber, etc., may be used as such elements. The possibility of replacing the load-creating elements allows one to change the stiffness and resistance force, thanks to which the exerciser can be used for various purposes in rehabilitation, warm-ups, trainings, neck strengthening with different complexity and load of exercises.

The elastic load-creating elements 6 are attached at one end to the head band 5 and at another end to the upper part of the brackets 4 fixed to a rim with the possibility of their replacement. As a result of the connection of the elastic elements 6, the head band is in the center of the frame, suspended by the side-stretched load-creating elements 6.

Figure 4:
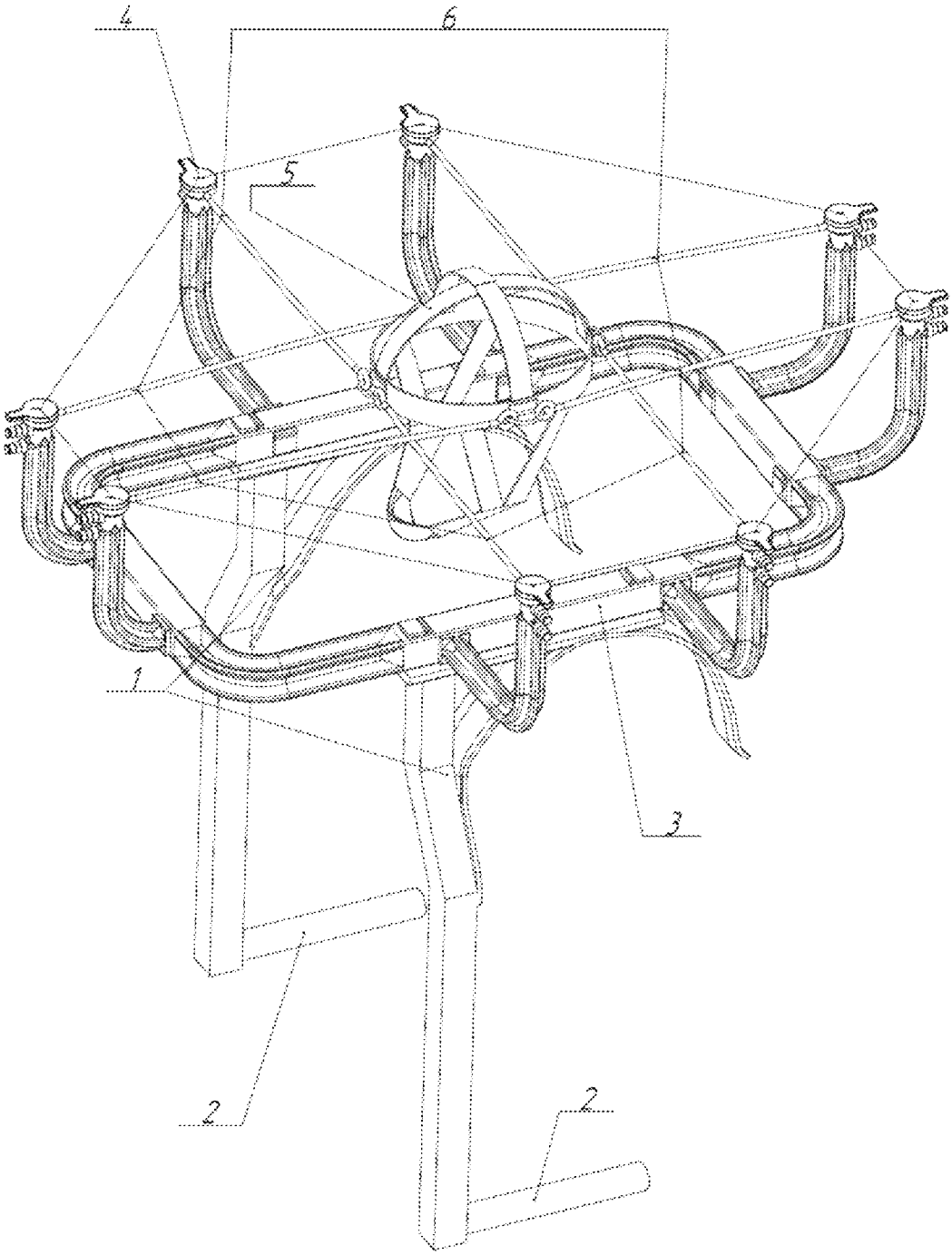
FIG. 4 shows an embodiment of the exerciser with two brackets on each side of its frame.

FIG. 4 shows the frame comprising two brackets on each side, providing a variation in the loads used.

The exerciser is used as follows.

In the assembled state, the exerciser is "dressed" over the head. The shoulder rests are placed on the shoulders, and the band is placed on the head (it is recommended to use thin caps under the band for hygienic purposes and to avoid pinching of skin and hair by the elements of the band). The handles are held by the hands. Exercises are performed by tilting the head in all directions: forward, backward, right, left, at all angles.

By replacing the load-creating elements, one can adjust the effort applied for head tilts.

Work with the exerciser is based on smoothly progressive movements in all directions, thanks to which it is possible to achieve the correct development and correction of the neck muscles.

The design of the exerciser allows stabilizing (fixing) the shoulders, thanks to which it is possible to achieve the same equal impact of the exerciser on the right side and the left side, thereby providing the same effect on the paired muscles. The exerciser helps to work with muscle imbalances in the cervical region. During the exercise, there are no upward or downward forces, all forces remain in the horizontal plane, with a slight inclination. It is important that all force vectors are created horizontally and the spine is vertical (perpendicular to the force vectors), thus eliminating tensile and compressive loads on the spine. Movements in all directions can be performed in any amplitude—from minimum to maximum-based on anatomical capabilities at any pace and with any load depending on the purpose of training. The effectiveness of training, especially in a rehabilitation period, is influenced by the maximum portability of the device and the ability to exercise anywhere. The design of the exerciser allows one to change the rigidity and strength of resistance by changing the load-creating elements (harnesses, rubber bands, springs, shock absorbers), as well as the number of the brackets. When the maximum number of the brackets is set, it is possible to use only those necessary at the moment, excluding the unnecessary ones. Thus, the proposed exerciser is more effective for training different muscles of the neck, safe in comparison with the prior art analogs, portable and ergonomic in use.

The invention claimed is:

1. A neck exerciser comprising:

a headband;

elastic load-creating elements being respectively connected at one end thereof to the headband;

a frame having a closed shape with a perimeter; (refer to the specification, as originally filed, paragraphs 0025-0027)

shoulder rests having handles; and brackets;

wherein the shoulder rests and the brackets are attached to the frame;

wherein the brackets are respectively attached on each side of the frame and respectively directed to an outer side of the frame;

wherein the brackets comprise vertical arms directed upwards; and wherein the elastic load-creating elements are respectively connected at another end thereof to the vertical arms of the brackets.

2. The neck exerciser of claim 1, wherein at least one of the brackets is provided on each side of the frame.

3. The neck exerciser of claim 1, wherein the elastic load-creating elements comprise springs, harnesses, a shock absorber, or rubber bands.

* * * * *